US010494755B2

(12) United States Patent
Heater et al.

(10) Patent No.: US 10,494,755 B2
(45) Date of Patent: Dec. 3, 2019

(54) SECONDARY DRYING CHAMBER FOR A CLOTHES DRYER

(71) Applicant: WHIRLPOOL CORPORATION, Benton Harbor, MI (US)

(72) Inventors: Timothy E. Heater, Hartford, MI (US); Nicholas E. Mawhorr, Granger, IN (US); Lisa M. Pawloski, Saint Joseph, MI (US); Anna C. Schelling, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 180 days.

(21) Appl. No.: 15/624,177

(22) Filed: Jun. 15, 2017

(65) Prior Publication Data

US 2018/0363231 A1 Dec. 20, 2018

(51) Int. Cl.

| | |
|---|---|
| ***F26B 11/00*** | (2006.01) |
| ***D06F 58/20*** | (2006.01) |
| ***D06F 58/02*** | (2006.01) |
| ***D06F 58/04*** | (2006.01) |

(52) U.S. Cl.

CPC ..... *D06F 58/20* (2013.01); *D06F 58/02* (2013.01); *D06F 58/04* (2013.01)

(58) Field of Classification Search

CPC ..... D06F 58/14; D06F 58/18; D06F 58/20; D06F 58/04

USPC .... 34/188, 109, 108, 418, 87, 126, 139, 187

See application file for complete search history.

(56) References Cited

U.S. PATENT DOCUMENTS

| | | | | |
|---|---|---|---|---|
| 2,628,432 A * | 2/1953 | Morrison | D06F 58/04 312/213 |
| 3,344,532 A | 10/1967 | Bigler | |
| 4,091,548 A * | 5/1978 | Daily | D06F 58/04 312/311 |
| 4,617,743 A | 10/1986 | Barnard | |
| 4,684,787 A | 8/1987 | Bunting | |
| 5,519,949 A | 5/1996 | Gibson, Jr. | |

(Continued)

FOREIGN PATENT DOCUMENTS

| | | |
|---|---|---|
| EP | 1405945 A2 | 4/2004 |
| EP | 1522625 A1 | 4/2005 |

(Continued)

OTHER PUBLICATIONS

European Search Report for Counterpart EP18164014.5, dated Oct. 11, 2018.

*Primary Examiner* — John P McCormack

(74) *Attorney, Agent, or Firm* — McGarry Bair PC

(57) ABSTRACT

A clothes dryer having a primary drying chamber with an air flow system having an inlet in the rear wall and an outlet on the front wall to define a primary air flow path through the primary drying chamber between the inlet and the outlet. A door movable between opened/closed positions to selectively open/close the primary drying chamber. A secondary drying chamber located adjacent the front wall to at least partially block access through the access opening without preventing rotation of the tub in the primary drying chamber. The secondary drying chamber also defining a secondary flow path through the drying basket to the front wall outlet. A scoop located within the primary drying chamber that deflects at least some of the air in the primary flow path to the secondary flow path.

23 Claims, 6 Drawing Sheets

(56) References Cited

U.S. PATENT DOCUMENTS

| | | | |
|---|---|---|---|
| 7,313,933 | B2 | 1/2008 | Carey et al. |
| 7,552,545 | B2 | 6/2009 | Crawford et al. |
| 2002/0092329 | A1 | 7/2002 | Rhode et al. |
| 2007/0089317 | A1 | 4/2007 | Crawford et al. |

FOREIGN PATENT DOCUMENTS

| | | | |
|---|---|---|---|
| EP | 2415920 | A1 | 2/2012 |
| WO | 0039383 | A1 | 7/2000 |
| WO | 2016119871 | A1 | 8/2016 |

* cited by examiner

SECONDARY DRYING CHAMBER FOR A CLOTHES DRYER

BACKGROUND OF THE INVENTION

Automatic clothes dryers work by passing heated air around and through damp laundry to absorb moisture and carry moisture away from the laundry, typically by venting it through a duct to an outdoor environment. A dryer has a cabinet that encloses the other elements of the dryer, including a stationary housing or bulkhead, and a drum supported within the housing into which the laundry is placed. The drum defines a primary drying chamber and rotates on its central axis, tumbling the laundry within it. A heating element heats ambient air drawn into the dryer through an inlet, typically located in a rear wall or bulkhead, where the air flows through the drum and out an outlet, typically located in a front wall or bulkhead.

SUMMARY

An exemplary embodiment of the description is a clothes dryer having a primary drying chamber with a front wall with an access opening, a rear wall spaced from the front wall, and a peripheral wall extending between the front and rear walls, with the peripheral wall rotating to define a rotatable primary drying chamber. The clothes dryer has an air flow system with an inlet in the rear wall and an outlet on the front wall to define a primary air flow path through the primary drying chamber between the inlet and the outlet. A door on the clothes dryer is movable between opened and closed positions to selectively open and close the primary drying chamber. A secondary drying chamber is located adjacent the front wall to at least partially block access through the access opening without preventing rotation of the peripheral wall. The secondary drying chamber also defines a secondary flow path through the drying basket to the outlet. A scoop is located within the primary drying chamber that deflects at least some of the air in the primary flow path to the secondary flow path.

DESCRIPTION OF EMBODIMENTS OF THE INVENTION

Figure 1:
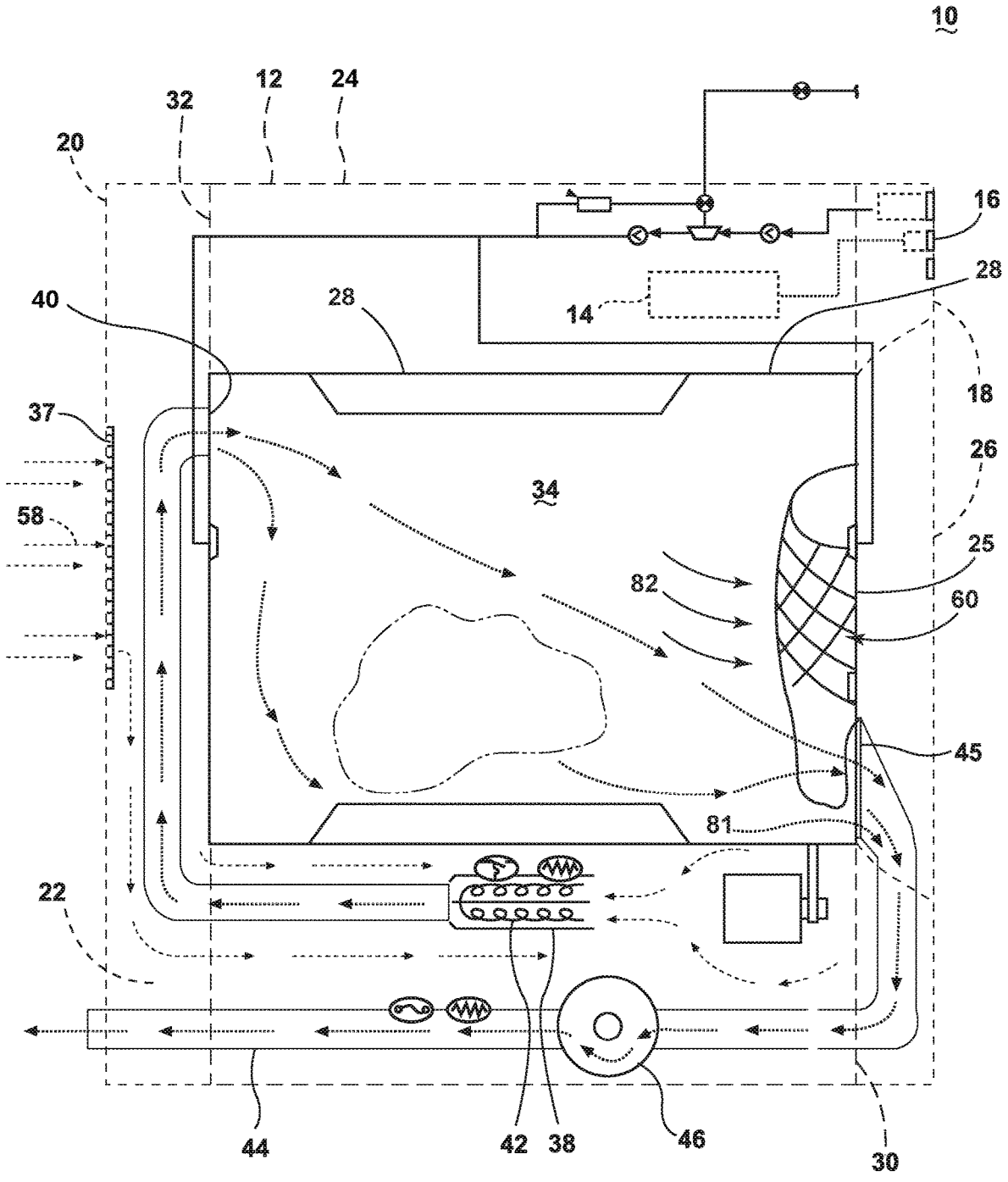
FIG. 1 is a schematic view of a laundry treating appliance in the form of a clothes dryer with a secondary drying chamber.

FIG. 1 is a detailed schematic view of an exemplary embodiment of a clothes dryer 10. The clothes dryer 10 described herein shares many features of a traditional automatic clothes dryer, which will not be described in detail except as necessary for a complete understanding of the invention. While embodiments of the invention are described in the context of a clothes dryer 10, the embodiments of the invention may be used in any context that includes opposed elements in relative motion wherein one slides against another effectively forming a barrier to a gas under pressure.

The clothes dryer 10 can include a cabinet 12 in which is provided a controller 14 that can receive input from a user through a user interface 16 for selecting a cycle of operation and controlling the operation of the clothes dryer 10 to implement the selected cycle of operation. The cabinet 12 can be defined by a front wall 18, a rear wall 20, and a pair of side walls 22 supporting a top wall 24. A door 26 can be hingedly mounted to the front wall 18 and can be selectively movable between opened and closed positions to close an access opening 25 in the front wall 18 of the cabinet 12.

A rotatable drum 28 can be disposed within the interior of the cabinet 12 between opposing stationary front and rear bulkheads 30, 32, which, along with the door 26, collectively define a primary drying chamber 34 for drying laundry. As illustrated, and as is the case with most clothes dryers, the primary drying chamber 34 is not fluidly coupled to a drain.

The clothes dryer 10 can also include a secondary drying chamber 60 removably positioned in the primary drying chamber 34. The secondary drying chamber 60 can be received in the primary drying chamber 34 before or after the door 26 is in a closed position, depending on the configuration, and is used for holding non-tumbling laundry in the clothes dryer 10. In an exemplary embodiment, the secondary drying chamber 60 does not interfere with laundry tumbling in the primary drying chamber 34. Accordingly, the clothes dryer 10 can accommodate multiple drying loads, a tumbling load and a non-tumbling load, to be dried at the same time in the clothes dryer 10.

An air flow system is also provided with the clothes dryer 10. The air flow system supplies and exhausts air to and out of the primary and secondary drying chambers 34, 60. The supplied air can be heated or not. The air flow system can have an air supply portion formed, in part, by a supply conduit 38, which has one end open to ambient air via a rear vent 37 and another end fluidly coupled to an inlet grill 40, which can be in fluid communication with both the primary and secondary drying chambers 34, 60. A heating element 42 can lie within the supply conduit 38 and can be operably coupled to and controlled by the controller 14. If the heating element 42 is turned on, the supplied air will be heated prior to entering the drum 28.

The air flow system further includes an air exhaust portion that can be formed, in part, by an exhaust conduit 44. An air outlet 45 can be provided from the primary and secondary drying chambers 34, 60 to the exhaust conduit 44. A blower 46 can be fluidly coupled to the exhaust conduit 44. The blower 46 can be operably coupled to and controlled by the controller 14. Operation of the blower 46 draws air into the primary and secondary drying chambers 34, 60 as well as exhausts air from the primary and secondary drying chambers 34, 60 through the exhaust conduit 44. The exhaust conduit 44 can be fluidly coupled with a household exhaust duct (not shown) for exhausting the air from the primary and secondary drying chambers 34, 60 to the outside of the clothes dryer 10.

In general, the controller 14 will effect a cycle of operation to effect drying of the laundry in the primary and secondary drying chambers 34, 60. The controller 14 can actuate the blower 46 to draw an inlet air flow 58 into the supply conduit 38 through the rear vent 37 when air flow is needed for a selected drying cycle. The controller 14 can activate the heating element 42 to heat the inlet air flow 58 as it passes over the heating element 42, with the heated air 59 being supplied to the primary and secondary drying chambers 34, 60. The heated air 59 can be in contact with a laundry load as it passes through the primary drying chamber 34 or passes through the secondary drying chamber 60 on its way to the air outlet 45 to effect a moisture removal of the laundry. The heated air 59 can exit the primary and secondary drying chambers 34, 60 through the air outlet 45, and flow through the blower 46 and the exhaust conduit 44 to the outside of the clothes dryer 10. Air that flows through the primary drying chamber 34 and out the air outlet is considered to have moved over primary air flow path 81. Air that flows through the primary drying chamber 34 into the secondary drying chamber 60 and out air outlet 45 is considered to have moved over secondary air flow path 82. The controller 14 continues the cycle of operation until completed. If the cycle of operation includes drying, the controller 14 determines when the laundry is dry.

Figure 2C:
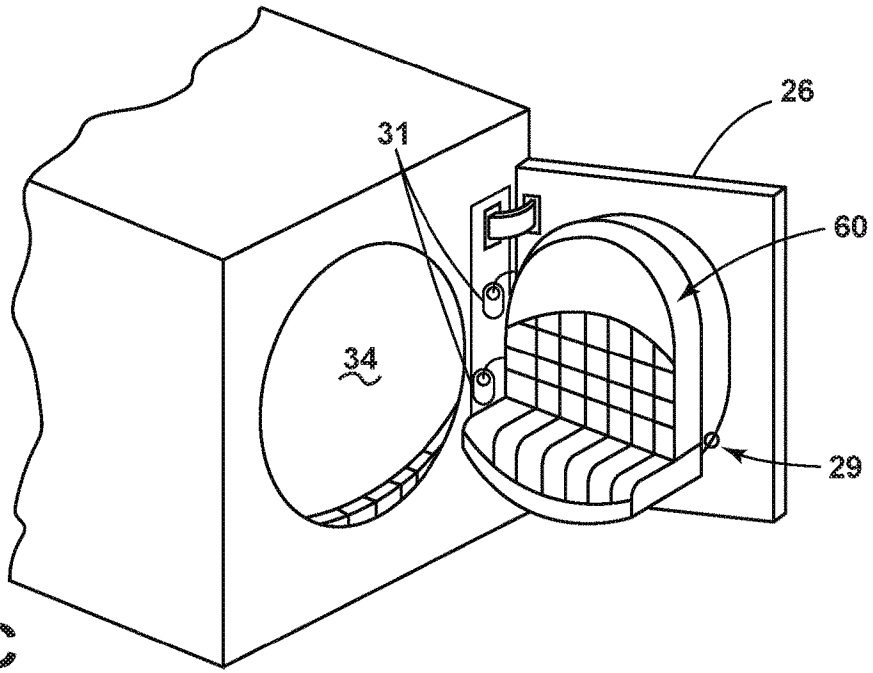
FIG. 2C is a perspective view of the clothes dryer of FIG. 2A with the secondary drying chamber shown in an alternate mounting to a door of the clothes dryer.
Figure 2A:
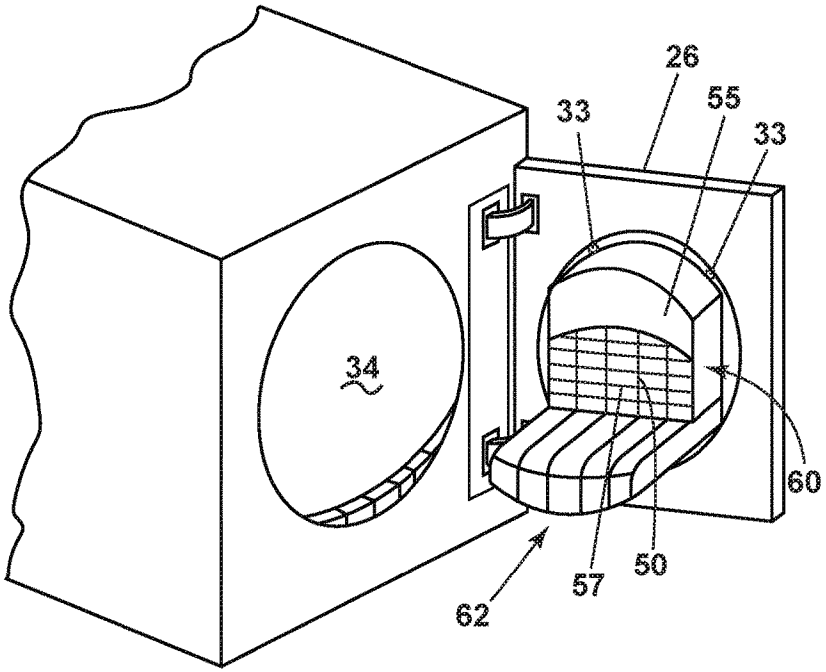
FIG. 2A is a perspective view of the clothes dryer of FIG. 1 with the secondary drying chamber shown mounted to a cabinet of the clothes dryer.

FIG. 2A is a perspective view of a clothes dryer 10 with the secondary drying chamber 60 removably secured to door 26. The secondary drying chamber 60 can be received in the primary drying chamber 34 when the door 26 is in a closed position. The secondary drying chamber 60 can be attached to door 26 in any number of ways without limiting the scope of the invention. For example, in exemplary embodiment shown in FIG. 2A, the secondary drying chamber 60 can be hung on the door 26 with clips 33 that allow the secondary drying chamber 60 to be removable connected to the door 26 as desired by the user.

The secondary drying chamber 60 has a top portion or deflector 55, a bottom portion or scoop 62 and basket portion 50 that defines a peripheral wall between the deflector 55 and scoop 62. The deflector 55 can comprise any type of solid or perforated material suitable to prevent laundry tumbling in the drum 28 from getting tangled with or caught on the secondary drying chamber 60. The basket portion 50 defines a housing which faces the interior of the clothes dryer 10 and can have an airflow inlet 57 configured to be porous to allow air to circulate through. The porosity of the basket portion 50 be comprised of a mesh or screen or any other material that allows sufficient airflow for laundry items in the secondary drying chamber 60 to be dried. The scoop 62 can also comprise a solid or perforated material that is airflow resistant and prevents airflow from passing through. The deflector 55 and scoop 62 can be designed so as to provide a structural foundation for the secondary drying chamber 60 and can encompass as much as or as little of the device height and width as needed.

Figure 2B:
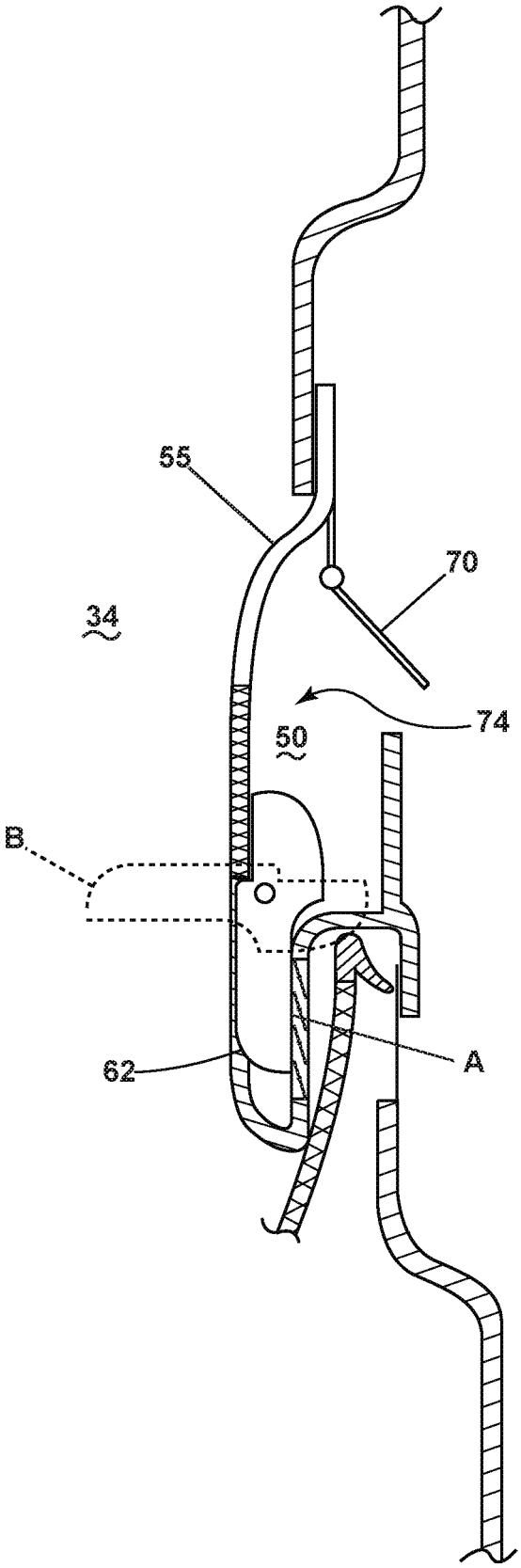
FIG. 2B is a side, cross-sectional view of the secondary drying chamber shown in FIG. 2A.

FIG. 2B depicts a side cross-sectional view of the secondary drying chamber 60 in FIG. 2A that illustrates an exemplary access panel 70 for allowing laundry to be loaded or unloaded from the basket portion 50. Access panel 70 could be positioned in any location on the secondary drying chamber 60 that allows convenient access for loading and unloading laundry. As illustrated, the access panel 70 is positioned on the rear peripheral wall of the secondary drying chamber 60. Access panel 70 provides an access opening 74 to basket portion 50. The access panel 70 could be of various shapes or sizes and could be secured to the secondary drying chamber 60 via hinge connection, sliding connection, or other mechanical connection allowing for opening and closing of the basket portion 50. For example, in the embodiment of FIG. 2A, the access panel 70 is hingedly mounted to the secondary drying chamber 60 and can be accessed prior to the secondary drying chamber 60 being hung or positioned on the door and in the embodiment of FIG. 2B, the access panel 70 can be accessed by pivoting the secondary drying chamber 60 away from the door 26, thereby allowing access to the access panel 70 by the user.

The basket portion 50 of secondary drying chamber 60 can be designed with multiple configurations or attachments for holding and or separating laundry. For example, the basket portion 50 can be designed as simply an empty basket or chamber where laundry is loaded and loosely rests on the bottom of the of secondary drying chamber 60 or the basket portion 50 can be designed with fixed or removable racks, shelves, hooks or other fasteners (not shown) to allow laundry to be hung or stacked within the secondary drying chamber 60. For example, a rack capable of supporting laundry could be secured in the secondary drying chamber 60 to allow laundry to drape around or hang over. Alternatively, the peripheral walls, themselves, that define the basket portion 50 of the secondary drying chamber 60 can comprise one or more racks or wires spaced from each other and made up of a sufficiently supportive material such as metal or plastic so that laundry can be draped around or over the rack peripheral walls for separating and hanging laundry articles.

Scoop 62 can be pivotable about basket portion 50 between extended position (A) and folded position (B). In the folded position (B), the scoop 62 fits within the access opening 25 of the door 26 and allows the door 26 to freely move from an open position to a closed position. Once the door 26 is moved to a closing or closed position, the scoop 62 pivots to the extended position (A). Upon re-opening the door 26, the scoop 62 pivots to the folded position (B). One of ordinary skill in art should recognize there are many ways to provide a pivotable scoop 62 on a secondary drying chamber 60 so that the scoop 62 is in a folded position (B) with the door 26 in an open position, and in an extended position (A) with the door 26 in a closed position, without limiting the scope of the invention.

FIG. 2C is an alternate embodiment of the secondary drying chamber 60 embodying the same principle features of the secondary drying chamber 60 shown in FIG. 2A, except showing an alternate way of removably connecting the secondary drying chamber 60 to the door 26. In this embodiment, the secondary drying chamber 60 can be pivotably connected to the door 26 with hinges 31 that allow the basket to swing relative to the door 26. An optional strap or locking mechanism 29 can be positioned on the secondary drying chamber 60 opposite the hinges 31 to secure the secondary drying chamber 60 in place.

Figure 3:
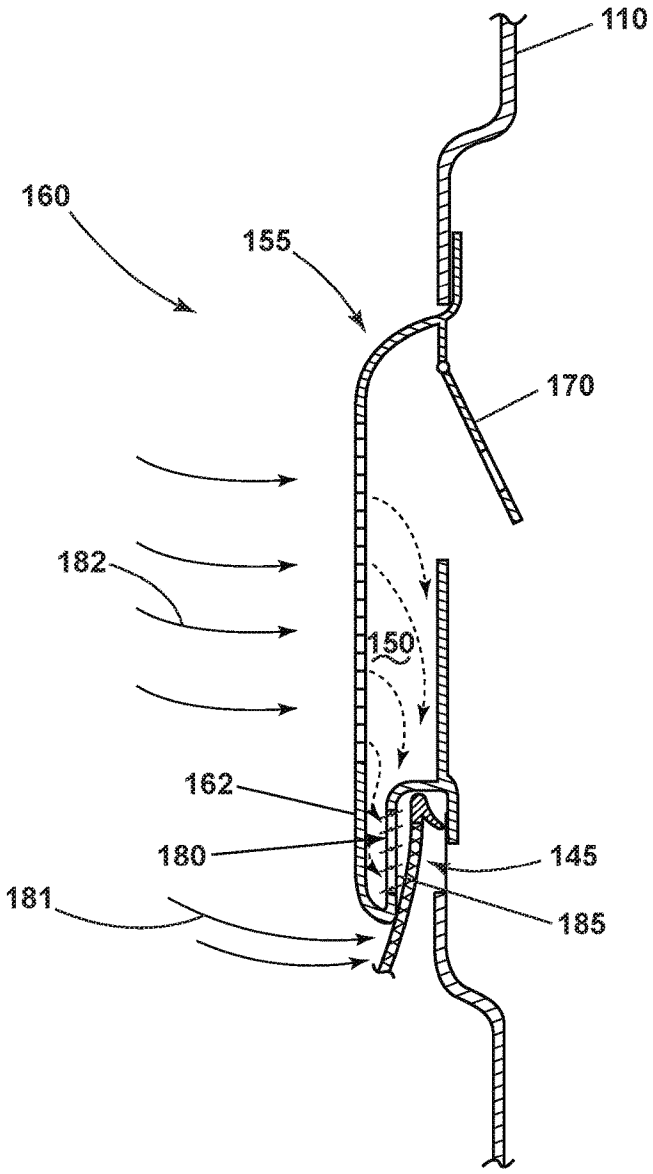
FIG. 3 is a side, cross sectional view of the secondary drying chamber carried on a clothes dryer.

FIG. 3 is a side cross-sectional view of another embodiment of a secondary drying chamber 160 carried on the clothes dryer 110 having a deflector 155, basket portion 150, scoop 162, and access door 170. While this example does not depict a pivotable scoop 162, such an embodiment would also be consistent with the exemplary embodiments of the invention. In this example, the secondary drying chamber 160 has an outlet 180 positioned opposite the scoop 162 near the bottom of the secondary drying chamber 160. The outlet 180 can be a mesh or screen that allows airflow to pass through. The outlet 180 of the secondary drying chamber 160 confronts at least a portion of the outlet 145 of the clothes dryer 110.

In operation, scoop 162 covers at least a portion of outlet 145, thereby blocking a portion of air outlet 145, and blocking a portion of air moving over primary air flow path 181. However, outlet 180 in the secondary drying chamber 160 creates a secondary air flow path 182 through the secondary drying chamber 160. In other words, the addition and use of a secondary drying chamber 160 in a clothes dryer 110 creates two separate air flows, primary air flow path 181 and secondary air flow path 182. In the primary air flow path 181, air flows from the inlet grill 140 in the primary drying chamber 134 and out of the clothes dryer 110 via outlet 145. In the secondary air flow path 182, air flows from the inlet grill 140 through the primary drying chamber 134 into a stationary load in the secondary drying chamber 160 and out the secondary drying chamber 160 via outlet 180. It should be recognized that the scoop 162 on the secondary drying chamber 160 can be designed to cover all or a portion of clothes dryer 110 outlet 145, but as illustrated the scoop 162 covers a portion of the outlet 145 to allow airflow to exit the dryer 110 through the primary and secondary air flow paths 181, 182.

The secondary drying chamber 160 can also comprise louvers 185 or other mechanical adjuster for regulating or controlling the flow of air through the secondary drying chamber 160. For example, an adjuster such as louvers 185 can be manually set by a user or automatically controlled by the user interface 114 based on cycle selection. Louvers 185 can be adjustable to control airflow by increasing or decreasing air flow through the secondary drying chamber 160 to accommodate for different laundry fabric. In other words, if louvers 185 are in an open position (as shown), airflow will travel through the primary and secondary air flow paths 181, 182 and exit the clothes dryer 110 via outlets 145, 180, respectively. If louvers 185 are in a closed position, airflow will generally only travel the primary air flow path 181 and exit the clothes dryer 110 via outlet 145.

Figure 4:
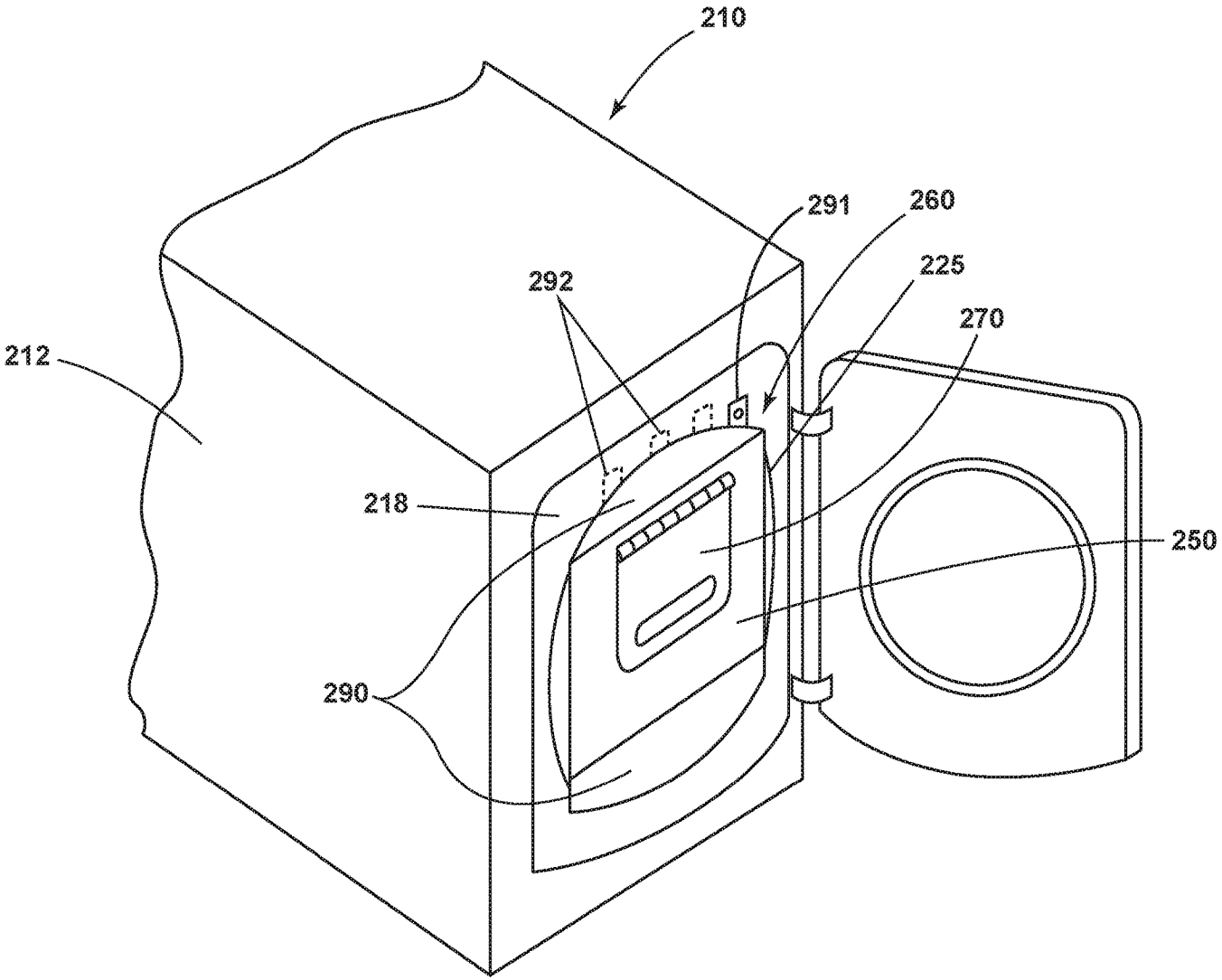
FIG. 4 is perspective view of the secondary drying chamber installed in a clothes dryer according to another embodiment of the invention.

FIG. 4 illustrates an alternate embodiment of a clothes dryer 210 having a secondary drying chamber 260 installed in access opening 225 that has similarities with the clothes dryer 10 of FIG. 2A. Therefore, elements of the clothes dryer 210 that are similar to the clothes dryer 10 are labeled with similar part numbers using the prefix 200. The drying chamber 260 has basket portion 250 and access opening 270. In this embodiment, secondary drying chamber 260 is carried or provided in the cabinet 212 so as to allow door 226 to freely open and close. The secondary drying chamber 260 can carry a flange 290 at its top and/or bottom (or circumferentially) for removably mounting the secondary drying chamber 260 within access opening 225. At its top, the flange 290 can carry one or more stops 292 or other/abutment attachment mechanism for abutting the top of access opening 225. The flange 290 or secondary drying chamber 260 can also have a recess on the bottom sized to receive an edge of the front wall 218 that defines the access opening 225. In this configuration, the secondary drying chamber 260 can be set into place by first setting the recess located on the bottom of the secondary drying chamber 260 or flange 290 on the edge of the front wall 218 of access opening 225 and tilting the secondary drying chamber 260 forward until the stops 292 on flange 290 abut the top of access opening 225; in essence, sandwiching the secondary drying chamber 260 in place in access opening 225. The secondary drying chamber 260 can be removed from the clothes dryer 210 by manually tilting the secondary drying chamber 260 out of the access opening 225 and lifting to disengage the secondary drying chamber 260 from the clothes dryer 210. The secondary drying chamber 260 can be installed so as to not impede the use of the door 226 or door switch 291. While the secondary drying chamber 260 is shown generally in a rectangular shape and removably fastening to clothes dryer 210 at the top of bottom of the access opening 225, it should be recognized that other shapes and mechanical fastening techniques are possible without limiting the scope of the invention.

Figure 5B:
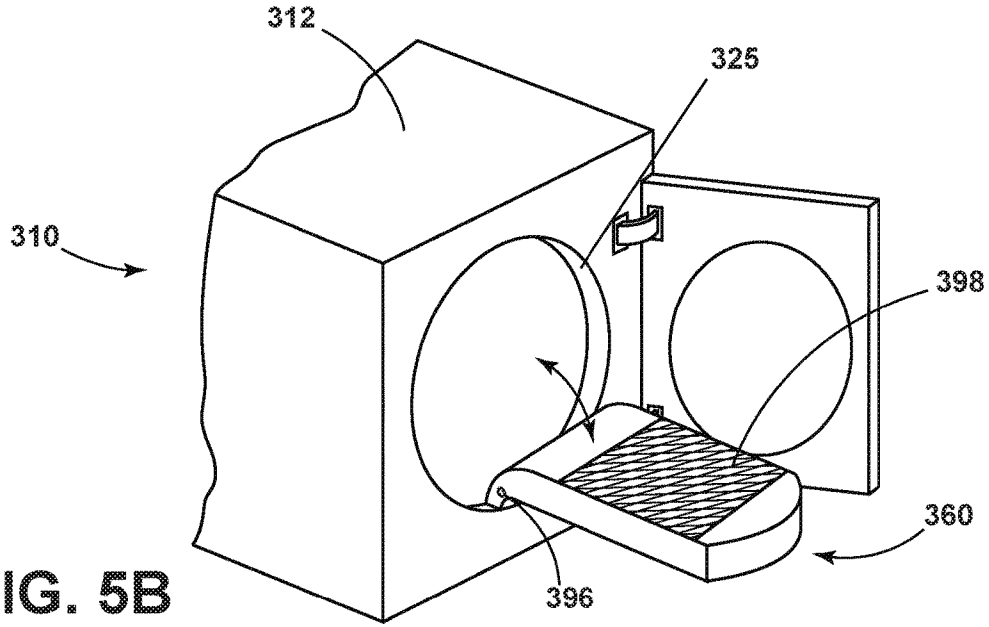
FIG. 5B is a perspective view of the secondary drying chamber installed in a clothes dryer according to another embodiment of the invention.
Figure 5A:
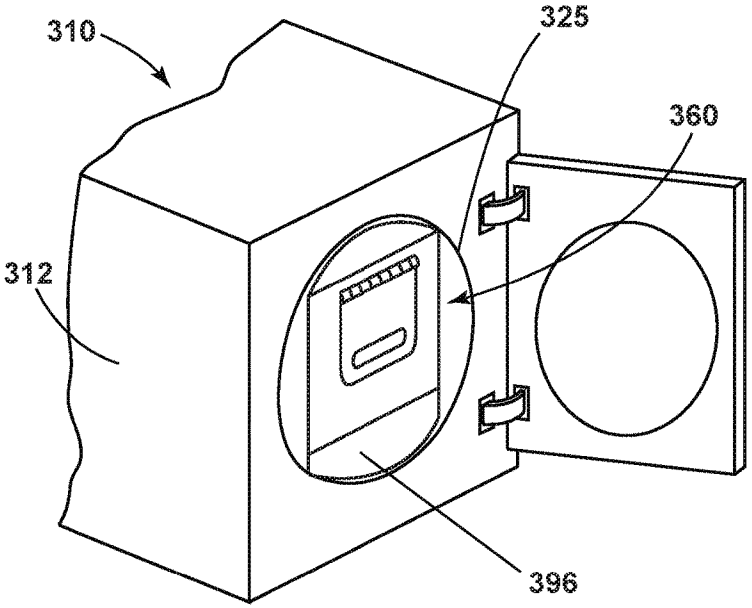
FIG. 5A is a perspective view of the secondary drying chamber installed in a clothes dryer according to another embodiment of the invention.

FIG. 5A illustrates an alternate embodiment of a clothes dryer 310 having a secondary drying chamber 360 installed in access opening 325 that has similarities with the clothes dryer 10 of FIG. 2A. Therefore, elements of the clothes dryer 310 that are similar to the clothes dryer 10 are labeled with similar part numbers using the prefix 300. Once again, the secondary drying chamber 360 can be designed to be removably secured or connected in access opening 325 of the clothes dryer 310 and in a position that allows door 326 of the clothes dryer 310 to freely open and close. In this example, the secondary drying chamber 360 can have a base 396 configured to be removably connected to the cabinet 312. Similar to the embodiment illustrated in FIG. 4, the base 396 can have a recess sized to receive an edge of the front wall 318 that defines the access opening 325 and configured to allow the secondary drying chamber 360 to pivot relative to the base 396. It should be noted that in this configuration, the secondary drying chamber 360 still has a scoop 362 at least partially covering outlet 345, so the secondary drying chamber 360 essentially pivots relative to the scoop 362 as well.

FIG. 5B illustrates the secondary drying chamber 360 of FIG. 5A being rotatable or pivotable into and out of the primary drying chamber 334. If the secondary drying chamber 360 is rotated out of the primary drying chamber 334, the peripheral wall of the secondary drying chamber 360 can be designed to be relatively flat, thereby providing a work surface 398 for the user. Alternatively, if the secondary drying chamber 360 is rotated into the primary drying chamber 334 (not shown), the peripheral wall of the secondary drying chamber 360 may act as a drying rack, where items such as shoes may be placed for drying. In either case, the peripheral wall of the secondary drying chamber 360 is intended to pivot to a generally horizontal position either interiorly or exteriorly to the drying chamber 334.

To the extent not already described, the portions features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

We claim:

1. A clothes dryer comprising:

a primary drying chamber comprising a front wall with an access opening, a rear wall spaced from the front wall, and a peripheral wall extending between the front and rear walls, with at least the peripheral wall rotating to define a rotatable primary drying chamber;

an air flow system comprising an inlet in the rear wall and an outlet on the front wall to define a primary air flow path through the primary drying chamber between the inlet and the outlet;

a door movable between opened/closed positions to selectively open/close the primary drying chamber;

a secondary drying chamber located adjacent the front wall to at least partially block access through the access opening without preventing rotation of the peripheral wall, and defining a secondary flow path through the secondary drying chamber to the outlet; and a scoop located within the primary drying chamber so as to deflect at least some of the air in the primary flow path to the secondary flow path.

2. The clothes dryer of claim 1 wherein the secondary drying chamber is removably secured to the front wall of the clothes dryer.

3. The clothes dryer of claim 2 wherein the secondary drying chamber is removably secured in the access opening of the front wall.

4. The clothes dryer of claim 1 wherein the secondary drying chamber is removably secured to the door of the clothes dryer.

5. The clothes dryer of claim 1 wherein the scoop is adjustable so as to control airflow between the primary and secondary flow paths.

6. The clothes dryer of claim 1 wherein the scoop is part of the secondary drying chamber.

7. The clothes dryer of claim 1 wherein the secondary drying chamber comprises a deflector, a scoop and a basket portion defining a peripheral wall extending between the deflector and the scoop.

8. The clothes dryer of claim 7 wherein the scoop comprises an airflow resistant portion.

9. The clothes dryer of claim 8 wherein the scoop is pivotally mounted to the basket portion.

10. The clothes dryer of claim 1 wherein the secondary drying chamber comprises an access opening.

11. The clothes dryer of claim 1 wherein the secondary drying chamber is pivotal relative to the scoop.

12. The clothes dryer of claim 1 wherein the scoop is pivotal between an extended position, when the door is in the closed position, and a folded position, when the door is in the opened position.

13. The clothes dryer of claim 1 wherein the secondary drying chamber is pivotally mounted to the door.

14. A clothes dryer comprising:

a primary drying chamber comprising a front wall with an access opening, a rear wall spaced from the front wall, and a peripheral wall extending between the front and rear walls, with at least the peripheral wall rotating to define a rotatable primary drying chamber;

an air flow system comprising an inlet in the rear wall and an outlet on the front wall to define a primary air flow path through the primary drying chamber between the inlet and the outlet;

a door movable between opened/closed positions to selectively open/close the primary drying chamber;

a secondary drying chamber located adjacent the front wall to at least partially block access through the access opening without preventing rotation of the peripheral wall, and defining a secondary flow path through the secondary drying chamber to the outlet; and a scoop located within the primary drying chamber so as to deflect at least some of the air in the primary flow path to the secondary flow path;

wherein the secondary drying chamber comprises a base and the secondary drying chamber is pivotal relative to the base.

15. The clothes dryer of claim 14 wherein the secondary drying chamber pivots out of the primary drying chamber.

16. The clothes dryer of claim 15 where the secondary drying chamber pivots to a generally horizontal position exteriorly of the primary drying chamber.

17. The clothes dryer of claim 16 where the secondary drying chamber pivots to a generally horizontal position interiorly of the primary drying chamber.

18. A clothes dryer comprising:

a primary drying chamber comprising a front wall with an access opening, a rear wall spaced from the front wall, and a peripheral wall extending between the front and rear walls, with at least the peripheral wall rotating to define a rotatable primary drying chamber;

an air flow system comprising an inlet in the rear wall and an outlet on the front wall to define a primary air flow path through the primary drying chamber between the inlet and the outlet;

a door movable between opened/closed positions to selectively open/close the primary drying chamber;

a secondary drying chamber located adjacent the front wall to at least partially block access through the access opening without preventing rotation of the peripheral wall, and defining a secondary flow path through the secondary drying chamber to the outlet; and a scoop located within the primary drying chamber so as to deflect at least some of the air in the primary flow path to the secondary flow path;

wherein the secondary drying chamber comprises an inlet of the secondary drying chamber and an outlet of the secondary drying chamber, with the secondary flow path extending between the inlet of the secondary drying chamber and the outlet of the secondary drying chamber.

19. The clothes dryer of claim 18 wherein the secondary drying chamber outlet is adjacent the front wall outlet.

20. The clothes dryer of claim 19 wherein the secondary drying chamber comprises a screen defining at least one of the inlet of the secondary drying chamber and the outlet of the secondary drying chamber.

21. The clothes dryer of claim/wherein the outlet of the secondary drying chamber is located at a bottom opposite a deflector.

22. The clothes dryer of claim 21 wherein the outlet comprises an adjuster moveable between an open position to allow air flow through the outlet of the secondary drying chamber and a closed position to prevent airflow through the outlet of the secondary drying chamber.

23. The clothes dryer of claim 22 wherein the adjuster comprises louvers.

* * * * *